US010969169B2

(12) United States Patent
Baxter et al.

(10) Patent No.: US 10,969,169 B2
(45) Date of Patent: Apr. 6, 2021

(54) METHOD OF SEPARATING COMPONENTS OF A GAS

(71) Applicant: Sustainable Energy Solutions, Inc., Provo, UT (US)

(72) Inventors: Larry Baxter, Orem, UT (US); Chris Hoeger, Provo, UT (US); Jacom Chamberlain, Provo, UT (US); Kyler Stitt, Lindon, UT (US)

(73) Assignee: Sustainable Energy Solutions, Inc., Provo, UT (US)

( * ) Notice: Subject to any disclaimer, the term of this patent is extended or adjusted under 35 U.S.C. 154(b) by 178 days.

(21) Appl. No.: 16/035,564

(22) Filed: Jul. 13, 2018

(65) Prior Publication Data

US 2020/0018547 A1 Jan. 16, 2020

(51) Int. Cl.

| | |
|---|---|
| ***F25J 3/02*** | (2006.01) |
| ***F25J 3/08*** | (2006.01) |
| ***B01D 5/00*** | (2006.01) |
| ***C07C 7/04*** | (2006.01) |

(52) U.S. Cl.

CPC ..... *F25J 3/08* (2013.01); *F25J 2205/02* (2013.01); *F25J 2205/20* (2013.01); *F25J 2205/30* (2013.01); *F25J 2210/60* (2013.01); *F25J 2215/04* (2013.01); *F25J 2220/68* (2013.01); *F25J 2245/02* (2013.01)

(58) Field of Classification Search

CPC ..... F25J 3/02; F25J 3/0209; F25J 3/08; F25J 3/065; F25J 3/02666; F25J 2270/08; B01D 5/0027; C07C 7/04; C07C 7/10

See application file for complete search history.

(56) References Cited

U.S. PATENT DOCUMENTS

| | | | | |
|---|---|---|---|---|
| 2,528,028 A * | 10/1950 | Barry | C10G 7/00 585/15 |
| 3,376,709 A * | 4/1968 | Dickey | C07C 7/14 62/637 |
| 3,724,226 A * | 4/1973 | Pachaly | F25J 1/0282 62/613 |
| 2019/0128603 A1* | 5/2019 | Baxter | B01D 7/02 |

* cited by examiner

*Primary Examiner* — Frantz F Jules
*Assistant Examiner* — Erik Mendoza-Wilkenfel
(74) *Attorney, Agent, or Firm* — Cook Alex Ltd.; R. Blake Johnston

(57) ABSTRACT

A method is disclosed for separating components of a gas. A feed gas stream is passed into a vessel. The feed gas stream includes methane, carbon dioxide, and water. The feed gas stream is cooled in the vessel such that a portion of the methane and a portion of the carbon dioxide condense and a portion of the water desublimates, resulting in a product stream and a depleted gas stream exiting the vessel.

16 Claims, 4 Drawing Sheets

METHOD OF SEPARATING COMPONENTS OF A GAS

GOVERNMENT INTEREST STATEMENT

This invention was made with government support under DE-FE0028697 awarded by the Department of Energy. The government has certain rights in the invention.

TECHNICAL FIELD

The devices and processes described herein relate generally to separation of gases.

BACKGROUND

Separating gases from other gases is a challenge in any industry. In some instances, such as in natural gas production, the gases to be removed can not only lower the value of the natural gas but can make it unusable unless purified. Many processes exist for stripping contaminants out of natural gas, but they suffer from a variety of downsides. Some are energy inefficient. Some have limited extraction capacity. Some are not feasible in remote locations, where natural gas is typically located. Energy efficient and cost-effective methods for purifying natural gas streams are needed.

SUMMARY

In one aspect, the disclosure provides a method for separating components of a gas. A feed gas stream is passed into a vessel. The feed gas stream includes methane, carbon dioxide, and water. The feed gas stream is cooled in the vessel such that a portion of the methane, a first portion of the carbon dioxide, and a first portion of the water condense, resulting in a product stream and a depleted gas stream exiting the vessel.

The feed gas stream may also consist of a secondary component which may include carbon dioxide, NGLs, nitrogen, argon, hydrogen sulfide, mercaptans, hydrogen, or a combination thereof. The NGLs may include ethane, propane, butane, isobutane, pentane, natural gasoline, cyclic hydrocarbons, aromatic hydrocarbons, or a combination thereof.

Cooling the fed gas stream may condense a portion of the secondary component into the product stream, desublimate a portion of the secondary component into the product stream, or a combination thereof. The product stream may be separated into a liquid product stream and a solids stream. The solids stream may be separated into a water stream and a secondary component stream.

In a second aspect, cooling the feed gas stream desublimates a second portion of the carbon dioxide and a second portion of the water as a solid product stream.

In a third aspect, the disclosure provides a method for separating components of a gas. A feed gas stream is passed into a vessel. The feed gas stream consists of methane, carbon dioxide, and water. The feed gas stream is cooled in the vessel such that a first portion of the carbon dioxide and a first portion of the water condense, resulting in a product stream and a depleted gas stream.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
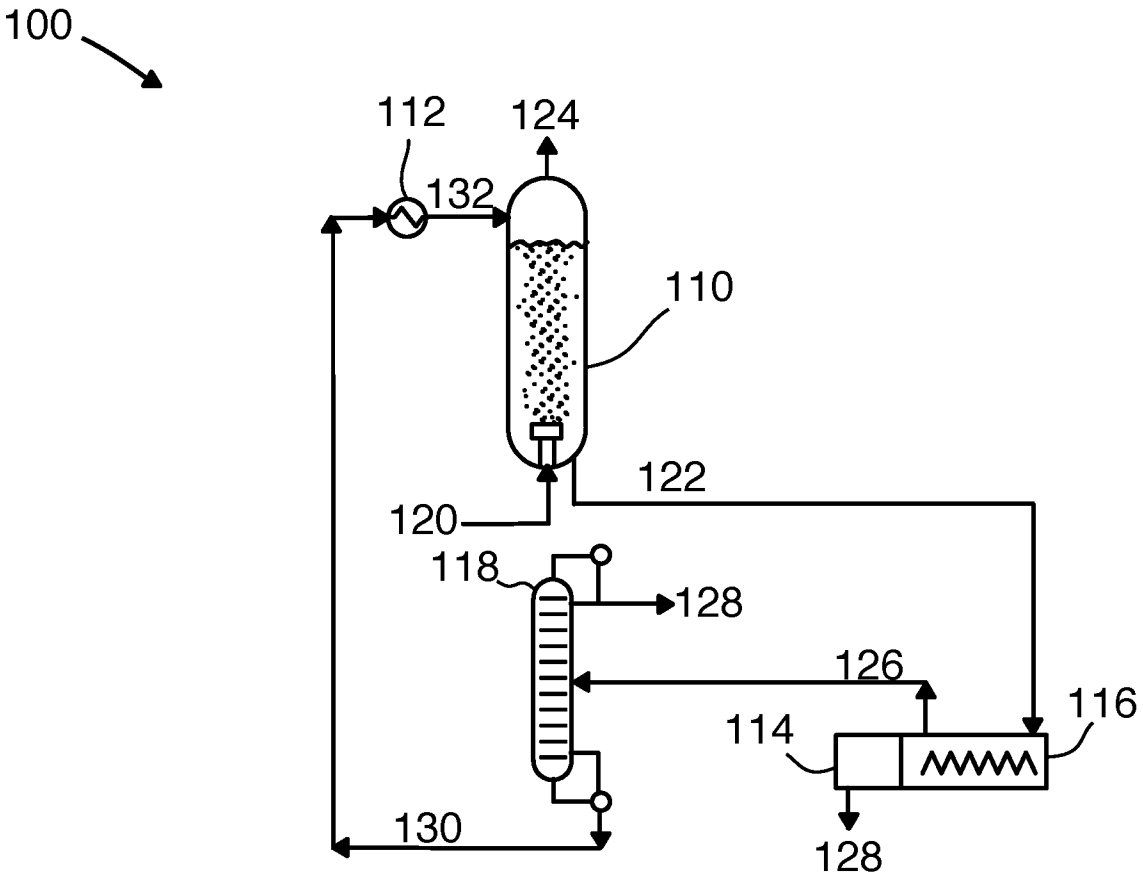
FIG. 1 is a flow diagram showing a process for separating components of a gas.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, "natural gas" is meant to refer to a methane containing gas stream. Natural gas, as harvested in the field, contains at least water and carbon dioxide. In many instances, natural gas may also contain NGLs, nitrogen, argon, hydrogen sulfide, and hydrogen.

As used herein, the term "NGLs" is meant to refer to compounds selected from the group consisting of ethane, propane, butane, isobutane, pentane, natural gasoline, cyclic hydrocarbons, aromatic hydrocarbons, and combinations thereof.

As used herein, "cryogenic" is intended to refer to temperatures below about −58° F. (−50° C.).

As used herein, "desublimate" refers to the process of a gas changing to a solid state directly, without passing through the liquid phase. This is to distinguish it from the term, "condense," which is used herein to refer to the process of a gas changing to a liquid state directly. The term "solidify" refers to the process of a liquid changing to a solid.

As used herein, "liquid-liquid" separators refer to a device that separates one liquid compound from another liquid compound. This includes decanters, centrifuges, settling tanks, thickeners, clarifiers, distillation columns, flash vessels, or similar devices used in the art.

Purifying natural gas can be complex and energy inefficient. The methods, devices, and systems disclosed herein overcome these limitations, as well as providing other benefits that will be apparent to those of skill in the art. A natural gas stream is cooled in an exchanger. This exchanger has the necessary temperature gradients and pressure to condense a portion of the methane and a portion of the carbon dioxide and to desublimate substantially all of the water and at least a portion of the carbon dioxide present in the natural gas stream, resulting in a solid. process individually, as detailed below.

The preferred methods, devices, and systems disclosed herein have advantages compared to some current technologies. These may include:

1. Avoiding the chemical hazards and costs associated with amine absorption technologies;

2. Combining natural gas sweetening ($CO_2$ removal), drying ($H_2O$ removal), NGLs recovery, and trace gas mitigation ($H_2S$ and $N_2$ removal) into a single process step and vessel;

3. Treating natural gas without reducing pressure, thereby decreasing repressurization equipment requirements and costs while also decreasing equipment size;

4. Improving NGLs recovery;

5. Enabling treatment of high-carbon dioxide natural gas streams;

6. Reducing treatment facility size, health and environmental hazards, and capital costs; and, 7. Reducing process energy consumption and cost.

The methods, devices, and systems disclosed are used to treat natural gas at typical plant delivery pressures of 60-100 bar, as well as other natural gas streams. The single step process simultaneously removes moisture, and carbon dioxide and methane. When NGLs are present, these are also removed in the single step. This may occur in a single vessel, such as in an indirect-contact exchanger or in a direct-contact exchanger configured as a counter-current spray column, packed column, staged column, or other vessels typically used for direct-contact exchange. As the gases condense, the volumetric flow rate and downstream equipment sizes decrease significantly. The products from the vessel, after solid-liquid separation, may be rewarmed to near the initial operating temperature by helping to pre-cool upstream flows.

FIG. 1 is a flow diagram 100 showing a process for separating components of a gas that may be used in the methods and systems disclosed. A feed gas stream 120, consisting of methane, carbon dioxide, water, and a secondary component, is bubbled into an exchanger 110. The vessel 110 is a bubbler-style direct-contact exchanger. The feed gas stream 120 is cooled by a descending contact liquid stream 132 such that a portion of the methane, a first portion of the carbon dioxide, and a first portion of the water condense to form a liquid. A second portion of the carbon dioxide, a second portion of the water, and the secondary component desublimate to form a solid. The solid and liquid leave exchanger 110 with the contact liquid stream 132 as a slurry stream 122. The feed gas stream 120 leaves exchanger 110 as a depleted gas stream 124. The slurry stream 122 is passed through a screw filtering device 116 where the liquid portion of the slurry product stream 126 is filtered out of the slurry product stream 122 as a mixed liquid stream 126. The solid remaining is passed into a melter 116 where it is melted to form an aqueous secondary product stream 128, consisting of the portion of the water and the portion of the secondary components, which is passed out of the melter 116. The mixed liquid stream 126 is passed into a distillation column 118, which removes the warm contact liquid 130 as a bottoms product, with the balance of the liquids leaving as mixed product stream 128. The warm contact liquid 130 is cooled across chiller 112 to produce the contact liquid 132.

Figure 2:
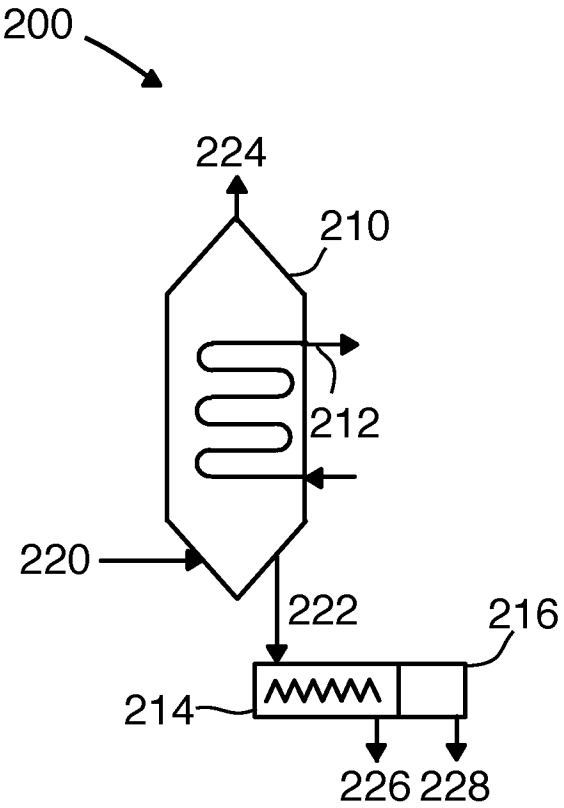
FIG. 2 is a flow diagram showing a process for separating components of a gas.

FIG. 2 is a flow diagram 200 showing a process for separating components of a gas that may be used in the methods and systems disclosed. A feed gas stream 220, consisting of methane, water, carbon dioxide, NGLs, nitrogen, argon, hydrogen sulfide, mercaptans, and hydrogen, is passed into an exchanger 210. The vessel 210 is an indirect-contact heat exchanger. The feed gas stream 220 is cooled across cooling coils 212 such that a portion of the methane, a first portion of the carbon dioxide, a first portion of the water, a portion of the hydrogen sulfide, and a lighter portion of the NGLs condense to form a liquid. A second portion of the carbon dioxide, a second portion of the water, a heavier portion of the NGLs, and a portion of the mercaptans desublimate to form a solid. The solid and the liquid leave exchanger 210 as a slurry stream 222. The feed gas stream 220 leaves exchanger 210, with primarily nitrogen, argon, and hydrogen, as a depleted gas stream 224. The slurry stream 222 is passed through a screw filtering device 216 where the liquids are filtered out of the slurry product stream 222 as a first liquid product stream 226. The solids remaining are passed into a melter 216 which melts the solids to produce a second liquid product stream 228. In some embodiments, a recycle stream of liquid methane is returned and added to the exchanger, acting as a contact liquid. The liquid methane is cooled by indirect cooling of coils 212 and then cools the incoming feed gas stream 220 directly, providing the greater surface area benefits of direct-contact exchange, but without the need for a separation process to remove the contact liquid. In other embodiments, a portion of the first liquid product stream 226 is used as the recycle stream. In other embodiments, a mixed stream of liquid methane and liquid carbon dioxide are used as the recycle stream.

Figure 3:
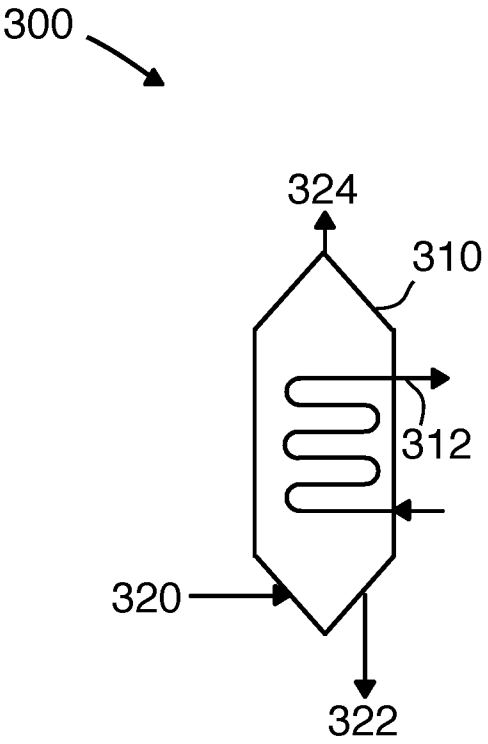
FIG. 3 is a flow diagram showing a process for separating components of a gas.

FIG. 3 is a flow diagram 300 showing a process for separating components of a gas that may be used in the methods and systems disclosed. A feed gas stream 320, consisting of methane, carbon dioxide, and water, is passed into an exchanger 310. The vessel 310 is an indirect-contact heat exchanger. The feed gas stream 320 is cooled across cooling coils 312 such that a portion of the methane, a portion of the carbon dioxide, and a portion of the water condense to form a liquid stream 322, which leaves exchanger 310. The feed gas stream 320 leaves exchanger 310 as a depleted gas stream 324.

In one embodiment, substantially all of the water is removed from the feed gas stream. In a preferred embodiment, "substantially all of the water" should leave no more than 1 ppm water in the depleted gas stream. In a more preferred embodiment, "substantially all of the water"

should leave no more than 100 ppb water in the depleted gas stream. In an even more preferred embodiment, "substantially all of the water" should leave no more than 10 ppb water in the depleted gas stream. In a most preferred embodiment, "substantially all of the water" should leave no more than 1 ppb water in the depleted gas stream.

In one embodiment, substantially all of the NGLs is removed from the feed gas stream. In a preferred embodiment, "substantially all of the NGLs" should leave no more than 1 ppm NGLs in the depleted gas stream. In a more preferred embodiment, "substantially all of the NGLs" should leave no more than 100 ppb NGLs in the depleted gas stream. In an even more preferred embodiment, "substantially all of the NGLs" should leave no more than 10 ppb NGLs in the depleted gas stream. In a most preferred embodiment, "substantially all of the NGLs" should leave no more than 1 ppb NGLs in the depleted gas stream.

In one embodiment, substantially all of the carbon dioxide is removed from the feed gas stream. In a preferred embodiment, "substantially all of the carbon dioxide" should leave no more than 120,000 ppm carbon dioxide in the depleted gas stream. In a more preferred embodiment, "substantially all of the carbon dioxide" should leave no more than 50,000 ppm carbon dioxide in the depleted gas stream. In an even more preferred embodiment, "substantially all of the carbon dioxide" should leave no more than 1,000 ppm carbon dioxide in the depleted gas stream. In a most preferred embodiment, "substantially all of the carbon dioxide" should leave no more than 50 ppm carbon dioxide in the depleted gas stream.

Figure 4:
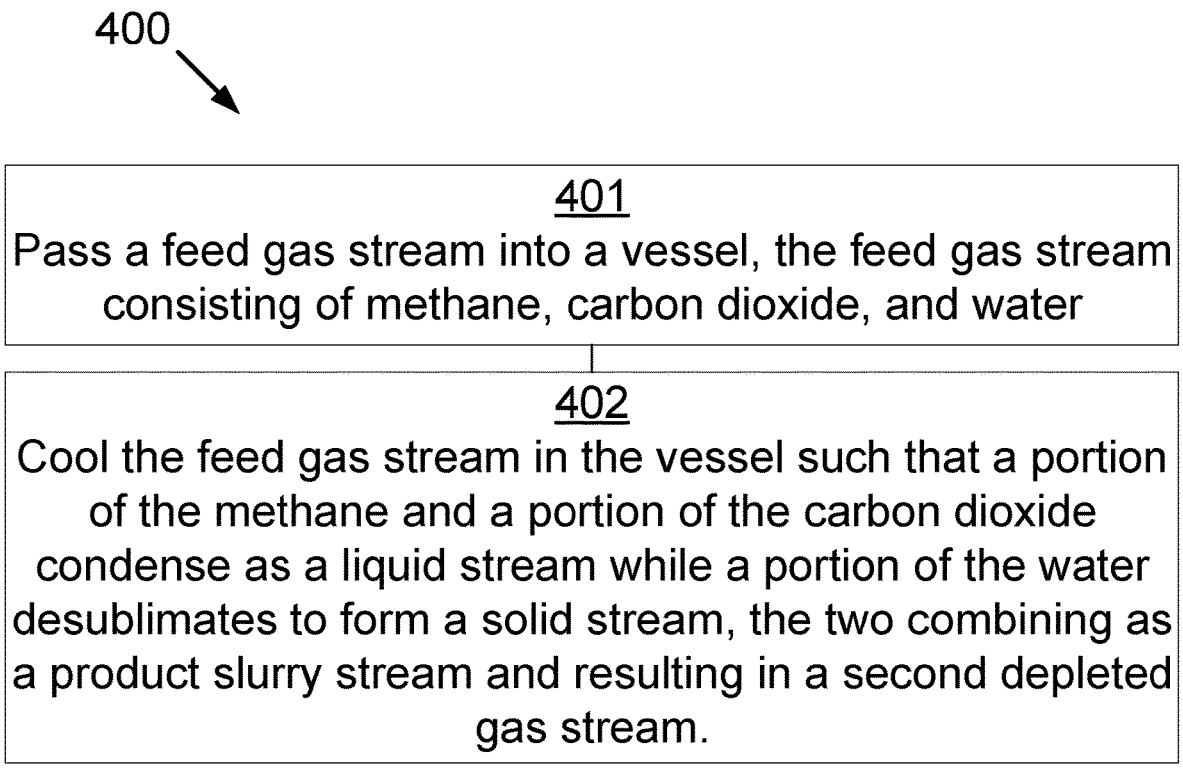
FIG. 4 is a block diagram depicting a method for separating components of a gas.

FIG. 4 is a method 400 for separating components of a gas that may be used in the methods, systems, and devices disclosed. At 401, a feed gas stream consisting of methane, carbon dioxide, and water is passed into a vessel. At 402, the feed gas stream is cooled in the vessel such that a portion of the methane, a first portion of the carbon dioxide, and a first portion of the water condense to form a product liquid stream and resulting in a depleted gas stream.

Figure 5:
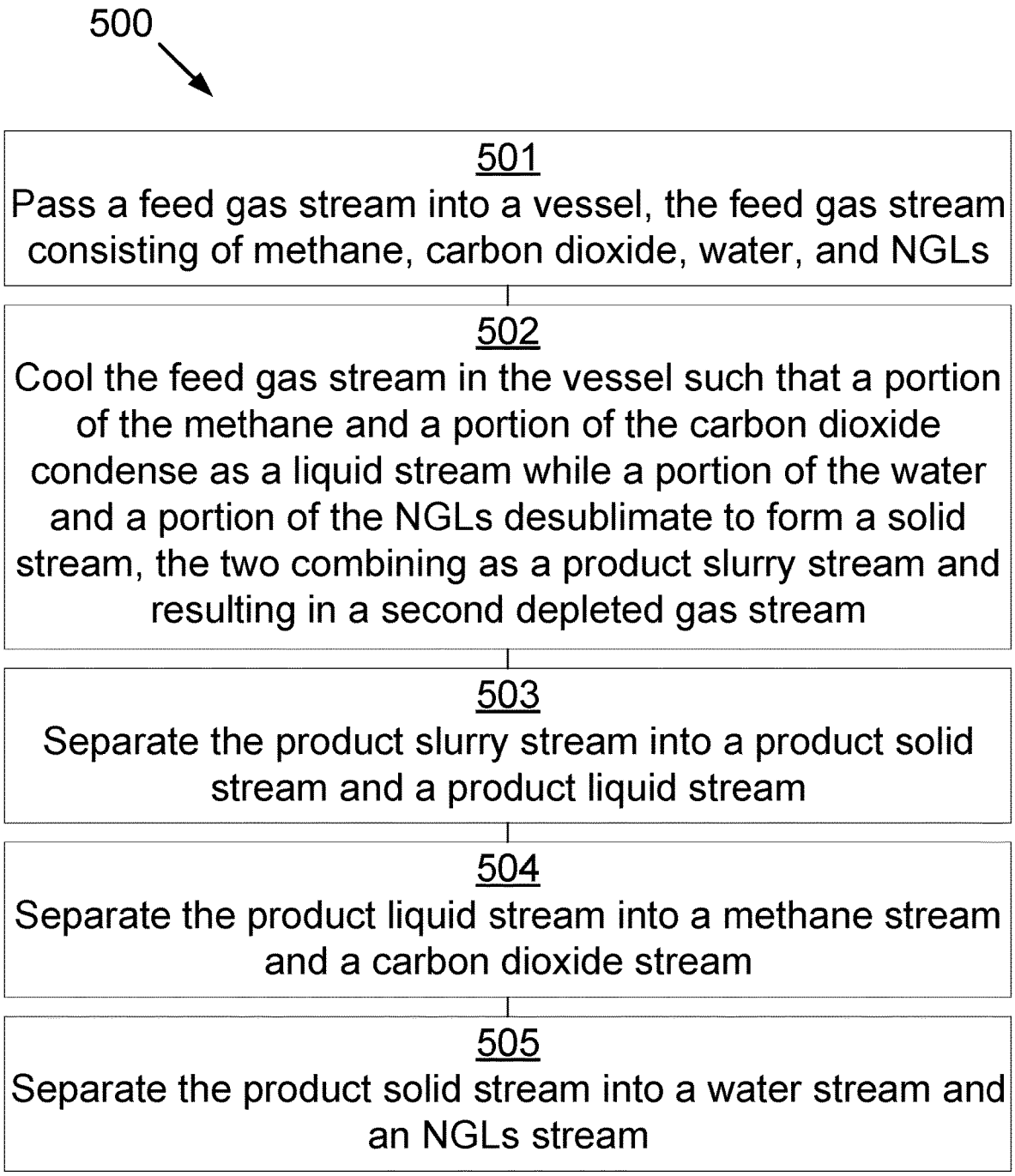
FIG. 5 is a block diagram depicting a method for separating components of a gas.

FIG. 5 is a method 500 for separating components of a gas that may be used in the methods, systems, and devices disclosed. At 501, a feed gas stream consisting of methane, water, carbon dioxide, and NGLs is passed into a vessel. At 502, the feed gas stream is cooled in the vessel such that a portion of the methane, a first portion of the carbon dioxide, a first portion of the water, and a first portion of the NGLs condense to form a liquid while a second portion of the water and a second portion of the NGLs desublimate to form a solid, the two combining as a product slurry stream and resulting in a depleted gas stream. At 503, the product stream is separated into a product liquid stream and a product solid stream. At 504, the product liquid stream is separated into a methane stream and a carbon dioxide stream. At 505, the product solid stream is separated into a water stream and a NGLs stream.

In some embodiments, the NGLs comprise compounds selected from the group consisting of ethane, propane, butane, isobutane, pentane, natural gasoline, cyclic hydrocarbons, aromatic hydrocarbons, or combinations thereof.

In some embodiments, the contact liquid stream may consist of water, ethers, alcohols, hydrocarbons, liquid ammonia, liquid carbon dioxide, cryogenic liquids, or a combination thereof.

In some embodiments, the contact liquid stream may consist of a mixture of a solvent and an ionic compound. The solvent may be water, hydrocarbons, liquid ammonia, liquid carbon dioxide, cryogenic liquids, or a combination thereof. The ionic compound may be potassium carbonate, potassium formate, potassium acetate, calcium magnesium acetate, magnesium chloride, sodium chloride, lithium chloride, calcium chloride, or a combination thereof.

In some embodiments, the contact liquid stream may be a mixture of a solvent and a soluble organic compound. The solvent may be water, hydrocarbons, liquid ammonia, liquid carbon dioxide, cryogenic liquids, or a combination thereof. The soluble organic compound may be glycerol, ammonia, propylene glycol, ethylene glycol, ethanol, methanol, or a combination thereof.

In some embodiments, the hydrocarbons may consist of 1,1,3-trimethylcyclopentane, 1,4-pentadiene, 1,5-hexadiene, 1-butene, 1-methyl-1-ethylcyclopentane, 1-pentene, 2,3,3,3-tetrafluoropropene, 2,3-dimethyl-1-butene, 2-chloro-1,1,1,2-tetrafluoroethane, 2-methylpentane, 3-methyl-1,4-pentadiene, 3-methyl-1-butene, 3-methyl-1-pentene, 3-methylpentane, 4-methyl-1-hexene, 4-methyl-1-pentene, 4-methylcyclopentene, 4-methyl-trans-2-pentene, bromochlorodifluoromethane, bromodifluoromethane, bromotrifluoroethylene, chlorotrifluoroethylene, cis 2-hexene, cis-1,3-pentadiene, cis-2-hexene, cis-2-pentene, dichlorodifluoromethane, difluoromethyl ether, trifluoromethyl ether, dimethyl ether, ethyl fluoride, ethyl mercaptan, hexafluoropropylene, isobutane, isobutene, isobutyl mercaptan, isopentane, isoprene, methyl isopropyl ether, methylcyclohexane, methylcyclopentane, methylcyclopropane, n,n-diethylmethylamine, octafluoropropane, pentafluoroethyl trifluorovinyl ether, propane, sec-butyl mercaptan, trans-2-pentene, trifluoromethyl trifluorovinyl ether, vinyl chloride, bromotrifluoromethane, chlorodifluoromethane, dimethyl silane, ketene, methyl silane, perchloryl fluoride, propylene, vinyl fluoride, or a combination thereof.

In one embodiment, cooling the feed gas stream condenses a portion of the carbon dioxide and a portion of the water, but none of the methane is condensed. This is useful when only some of the carbon dioxide and water need to be removed from the feed gas stream.

The invention has been described with reference to various specific and preferred embodiments and techniques. Nevertheless, it understood that many variations and modifications may be made while remaining within the spirit and scope of the invention.

What is claimed is:

1. A method for separating components of a gas comprising:

passing a feed gas stream into a vessel, wherein the feed gas stream comprises methane, carbon dioxide, and water;

cooling the feed gas stream in the vessel such that a portion of the methane, a first portion of the carbon dioxide, and a first portion of the water condense, resulting in a product stream and a depleted gas stream exiting the vessel;

wherein the vessel is a direct-contact exchanger that provides cooling by contact with a contact liquid stream;

separating the product stream into a solids product stream and a mixed contact liquid stream;

separating the contact liquid stream from the mixed contact liquid stream, resulting in a liquid product stream; and separating the liquid product stream into a methane stream and a carbon dioxide stream.

2. The method of claim 1, wherein the feed gas stream further comprises a secondary component selected from the group consisting of NGLs, nitrogen, argon, hydrogen sulfide, mercaptans, hydrogen, and combinations thereof.

3. The method of claim 2, wherein the NGLs comprise ethane, propane, butane, isobutane, pentane, natural gasoline, cyclic hydrocarbons, aromatic hydrocarbons, or a combination thereof.

4. The method of claim 2, wherein passing the feed gas stream into the vessel further comprises pressurizing the feed gas stream before the vessel.

5. The method of claim 2, wherein cooling the fed gas stream condenses a portion of the secondary component into the product stream, desublimates a portion of the secondary component into the product stream, or a combination thereof.

6. The method of claim 5, wherein cooling the feed gas stream causes at least a portion of the first portion of the carbon dioxide in the product stream to solidify to a solid carbon dioxide product stream.

7. The method of claim 5, wherein cooling the feed gas stream desublimates a second portion of the carbon dioxide and a second portion of the water as a solid product stream.

8. The method of claim 5, wherein cooling the feed gas stream causes a second portion of the carbon dioxide to absorb into the product stream.

9. The method of claim 1, wherein the contact liquid stream comprises a mixture of a solvent and an ionic compound, the solvent selected from the group consisting of water, hydrocarbons, liquid ammonia, liquid carbon dioxide, cryogenic liquids and combinations thereof, and the ionic compound selected from the group consisting of potassium carbonate, potassium formate, potassium acetate, calcium magnesium acetate, magnesium chloride, sodium chloride, lithium chloride, calcium chloride and combinations thereof.

10. The method of claim 1, wherein the contact liquid stream comprises a mixture of a solvent and a soluble organic compound, the solvent selected from the group consisting of water, hydrocarbons, liquid ammonia, liquid carbon dioxide, cryogenic liquids, or a combination thereof, and the soluble organic compound selected from the group consisting of glycerol, ammonia, propylene glycol, ethylene glycol, ethanol, methanol, or a combination thereof.

11. The method of claim 1, wherein the contact liquid stream is selected from the group consisting of ethers, alcohols, hydrocarbons, liquid ammonia, liquid carbon dioxide, cryogenic liquids, and combinations thereof.

12. The method of claim 11, wherein the alcohols are selected from the group consisting of methanol, ethanol, n-propanol, isopropanol, n-butanol, isobutanol, and combinations thereof.

13. The method of claim 1, wherein the contact liquid stream is at least partially immiscible with the methane such that the contact liquid stream and the methane form two liquid phases and the carbon dioxide partitions between the two phases.

14. The method of claim 13, further comprising separating the two phases.

15. A method for separating components of a gas comprising:

passing a feed gas stream into a vessel, wherein the feed gas stream comprises methane, carbon dioxide, and water;

cooling the feed gas stream in the vessel such that a portion of the methane, a first portion of the carbon dioxide, and a first portion of the water condense, resulting in a product stream and a depleted gas stream exiting the vessel;

wherein the vessel is a direct-contact exchanger that provides cooling by contact with a contact liquid stream; and wherein the contact liquid stream comprises a mixture of a solvent and a soluble organic compound, the solvent selected from the group consisting of water, hydrocarbons, liquid ammonia, liquid carbon dioxide, cryogenic liquids, or a combination thereof, and the soluble organic compound selected from the group consisting of glycerol, ammonia, propylene glycol, ethylene glycol, ethanol, methanol, or a combination thereof.

16. A method for separating components of a gas comprising:

passing a feed gas stream into a vessel, wherein the feed gas stream comprises methane, carbon dioxide, and water;

cooling the feed gas stream in the vessel such that a portion of the methane, a first portion of the carbon dioxide, and a first portion of the water condense, resulting in a product stream and a depleted gas stream exiting the vessel;

wherein the vessel is a direct-contact exchanger that provides cooling by contact with a contact liquid stream; and wherein the contact liquid stream is an alcohol selected from the group consisting of methanol, ethanol, n-propanol, isopropanol, n-butanol, isobutanol, and combinations thereof.

* * * * *